United States Patent [19]

Schmitz

[11] 4,279,139

[45] Jul. 21, 1981

[54] METHOD OF ROLLING ANGLE STRUCTURAL SHAPES

[75] Inventor: Fernand Schmitz, Lorentzweiler, Luxembourg

[73] Assignee: ARBED Aciéries Réunies de Burbach-Eich-Dudelange, Société Anonyme, Luxembourg, Luxembourg

[21] Appl. No.: 55,038

[22] Filed: Jul. 2, 1979

[51] Int. Cl.[3] ..... B21B 1/08

[52] U.S. Cl. ..... 72/234; 72/366

[58] Field of Search ..... 72/234, 181, 366, 199

[56] References Cited

U.S. PATENT DOCUMENTS

| | | | |
|---|---|---|---|
| 873,463 | 12/1907 | Slick | 72/234 |
| 3,877,275 | 4/1975 | Attwood | 72/234 |

FOREIGN PATENT DOCUMENTS

| | | | |
|---|---|---|---|
| 51-93771 | 8/1976 | Japan | 72/234 |
| 477591 | 1/1938 | United Kingdom | 72/234 |
| 476042 | 10/1975 | U.S.S.R. | 72/234 |

OTHER PUBLICATIONS

"Stahl und Eisen", vol. 72, 1952, No. 1, Jan., pp. 35–39.

"Stahl und Eisen", vol. 48, 1928, No. 4, Jan., pp. 98–101.

*Primary Examiner*—Milton S. Mehr

*Attorney, Agent, or Firm*—Karl F. Ross

[57] ABSTRACT

A method of rolling angle structural shapes in which a bar of rectangular profile is rolled in a first step to form a blank having a rounded convex protuberance on one side and a flat opposite side. In at least one subsequent state, the blank is rolled to transform the protuberance or hump into a triangular protuberance or ridge with flanks lying substantially at a right angle, whereupon the blank is bent, after rounding the edges of the flat surface, to form the angle profile.

8 Claims, 8 Drawing Figures

METHOD OF ROLLING ANGLE STRUCTURAL SHAPES

CROSS REFERENCE TO RELATED APPLICATION

This application is related to my concurrently filed, commonly assigned, copending application Ser. No. 54,792 which discloses subject matter dealing with the rolling of angle structural shapes having flanges of equal widths.

FIELD OF THE INVENTION

My present invention relates to a method of rolling structural shapes and, more particularly, to a method of rolling steel angle structural shapes.

BACKGROUND OF THE INVENTION

The angle structural shape generally comprises a pair of flanges lying substantially at a right angle to one another and formed with a radius or fillet along the interior of the vertex which is defined by the planar backs of the flanges or legs which adjoin at a sharp right angle.

The flanges may be of the same widths (equal widths) or of different widths, depending upon the use to which the angle iron or profile is to be put. Similarly the width of the flanges (lengths of the flange cross section) and the thickness of the flanges may be selected to suit the loading characteristics of the structural shape.

In the following description, reference may also be made to structural shape as a "profile", a term which has increasingly gained acceptance in the art.

Angle structural shapes of the type described above are basic elements in construction, forming corner members, connecting members, vertical and horizontal supports, can be welded or assembled with other angle profiles to produce more complex shapes and, generally, have wide application in all phases of the construction industry.

From the late 19th century through the turn of the century, and even to date, relatively complicated multipass rolling techniques have been used to produce these structural shapes. Indeed the basic descriptions of the processes date from 1875 and 1881 and involve seven and nine step rolling methods starting with a rectangular bar, for producing angle structural shapes. For the most part these techniques are effective only for producing angle shapes with equal flange widths and are relatively complicated, requiring a large number of pairs of rollers for the large number of passes which are involved.

In general these earlier techniques can be described as initially transforming a body of generally rectangular section into a blank having a central ridge angular cross section (triangular profile) which is maintained or sharpened in subsequent operations which progressively define the "wings" flanking the ridge. After six or eight passes, most of which result in a reduction of thickness of the wings, the latter are bent in the final rolling pass at right angles to one another to form the angle structural shape. These techniques are described subsequently with reference to the drawings.

Naturally, when a large number of passes are required to produce the angle shape, the number of man hours required for the setup of the mill for particular dimensions of these structural shapes is considerable, the equipment involved is complex and the output may be limited, all in spite of the relative simplicity of the angle structural shape.

OBJECTS OF THE INVENTION

It is the principal object of the present invention to provide an improved method of rolling angle structural shapes, especially equal width profiles but also unequal width profiles, whereby the disadvantages of earlier systems can be avoided.

Another object of this invention is to provide an improved method of rolling angle profiles which has a substantially reduced number of steps of comparison with earlier commercial and described processes.

SUMMARY OF THE INVENTION

These objects and others which will become apparent hereinafter are attained, in accordance with the present invention, wherein a substantially rectangular bar is rolled in a first pass to form a hump along one surface which has a convex, substantially semicircular cross section or profile and is flanked by two wings having a thickness of about one third (33%±8%) of the thickness of the bar. In a second pass this hump is transformed into a triangular profile with the flanks thereof at right angles to one another and the thickness again reduced by about one third (33%±8%) while in a third pass the lower outer edges of the blank, at the flat side of the blank opposite that provided with a hump, are rounded or radiused. In the fourth and last pass the wings are bent to form the flanges at right angles while the triangular-profile ridge forms the vertex.

It has been found to be advantageous to use a bar to start which has its opposite phases precisely parallel and the angularly adjoining phases precisely at right angles to one another. This bar can be rectangular (elongated cross section) or square and the rounded convex hump can have the semicircular cross section preferred or a droplet profile depending upon whether the final product is to be an equal width angle or an unequal width angle.

It is indeed surprising, considering the teachings and beliefs in the art, that it is possible in a single pass to form a blank which can be subsequently modified with a minimum of steps (only three) to provide the triangular ridge which ultimately forms the vertex for an angle shape since it has been generally thought that gradual formation of the ridge and progressive modification thereof before bending the wings at an angle were necessary requisites for the production of the angle shape. Thus, in all passes until the final pass the side opposite the ridge remains flat and planar without any recess.

It was felt that such care was necessary because accurate positioning of the ridge and its configuration were essential to the subsequent bending operation. This has been found to be a misstatement of the phenomenon since I have now discovered that the less well defined curved convex configuration can serve as a precursor for the angular definition of the triangular wedge in a single pass which can thereafter form the angular profile without difficulty.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
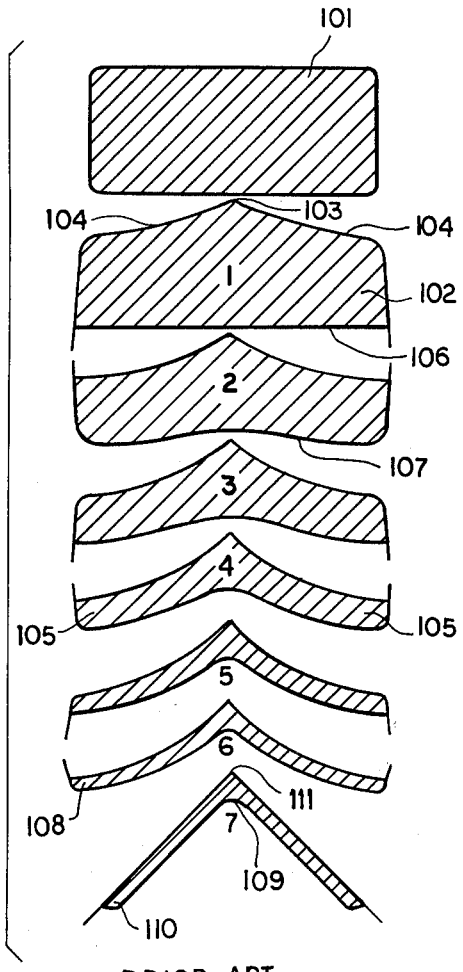
PRIOR ART FIG.1
FIG. 1 is a diagram illustrating the seven-pass system of the prior art.

FIG. 1 shows a prior art method of forming angle structural shapes 100 starting with a generally rectangular bar 101. This technique is the so-called butterfly method. In this approach, the bar 101 is rolled to a slight extent to form a blank 102 with a slight ridge 103 and a pair of concave flanks 104 which ultimately will define the wings 105 after a number of rolling steps. In the second pass 2, the underside 106, hitherto planar, is given a concave configuration as shown at 107 which is increased gradually in passes 3–6, the latter step imparting to the wings 105 the desired thickness and rounding the edges 108 thereof. The last step 7 bends the wings at right angles to one another to form the angle shape with its fillet 109 and reduced edges 110. The vertex 111 is clearly defined from an early stage in the rolling with increasing proximity to a right angle.

Throughout the thickness of the wings is reduced from rolling step to rolling step.

Figure 2:
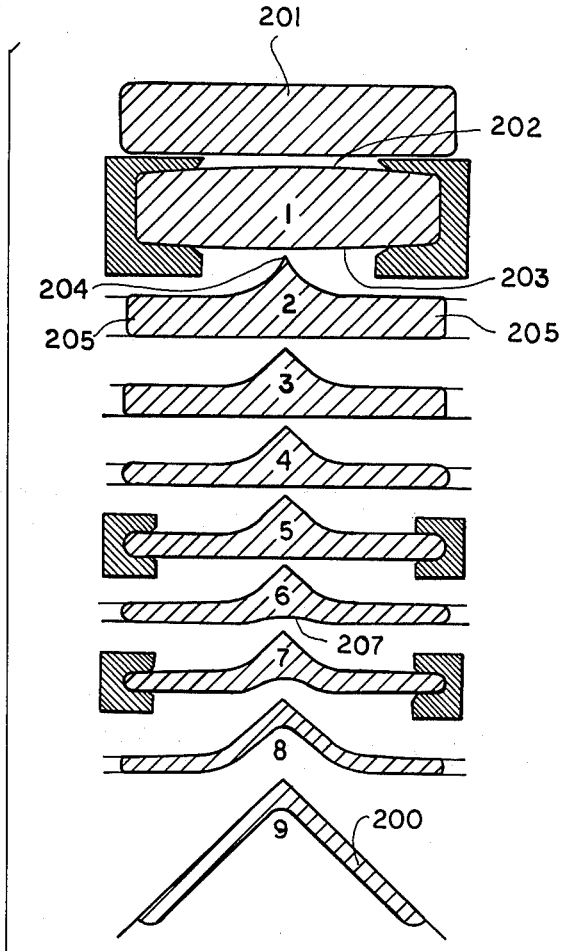
PRIOR ART FIG.2
FIG. 2 is a diagram of the nine-pass system of the prior art.

The other principal conventional method is shown in FIG. 2 in which the angle shape 200 is formed in nine steps, the rectangle 201 here receiving a slight convexity at its upper and lower surfaces 202, 203 in the first step 1, whereupon the thickness is reduced in step 2, while a triangular ridge 204 is provided between the wings 205 which have a thickness of 50% or more of the original thickness of the bar 201.

In the subsequent steps 3 through 5, the blank 206 is progressively reduced in thickness and a slight concavity 207 is formed in the blank at the sixth rolling step. This concavity is accentuated in the seventh and eighth steps with the wings being bent to the angle configuration in the ninth step.

Both in the prior-art methods described above and in the method of the invention to be described subsequently, for each step the rollers of the rolling mill stand must have the appropriate configuration and spacing.

Figure 3:
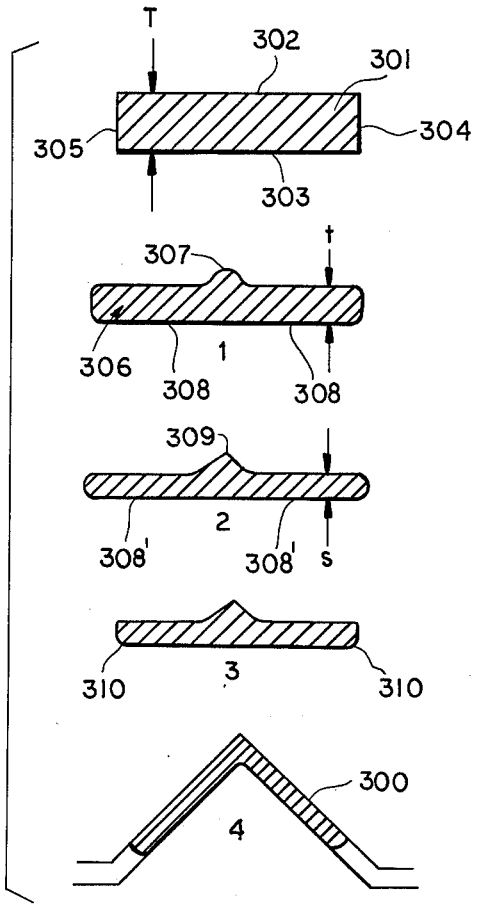
FIG. 3 is a corresponding diagram of the four-pass system of the present invention for forming equal width angle shapes.

As can be seen from FIG. 3, equal width angle shapes 300 can be formed in a maximum of four rolling steps starting with a rectangular bar 301 whose surfaces 302, 303 are parallel to one another and whose end faces 304, 305 are likewise parallel. According to the invention, a blank 306 is rolled from the bar 301 in a single pass and is formed in this pass with a semicircular protuberance 307 along its upper surface while the lower surface remains flat. The protuberance or bulge 307 subdivides the blank into wings 308 which should have a thickness which is equal to one third (±8%) the thickness T of the bar 301. In the next pass, the thickness of the wings 308' is reduced to about one third (±8%), while the hump 307 is transformed into the triangular ridge 309 whose flanks lie at right angles to one another. In the third pass, the lower edges 310 are rounded while the final pass bends the wings into the angle configuration.

Figure 4:
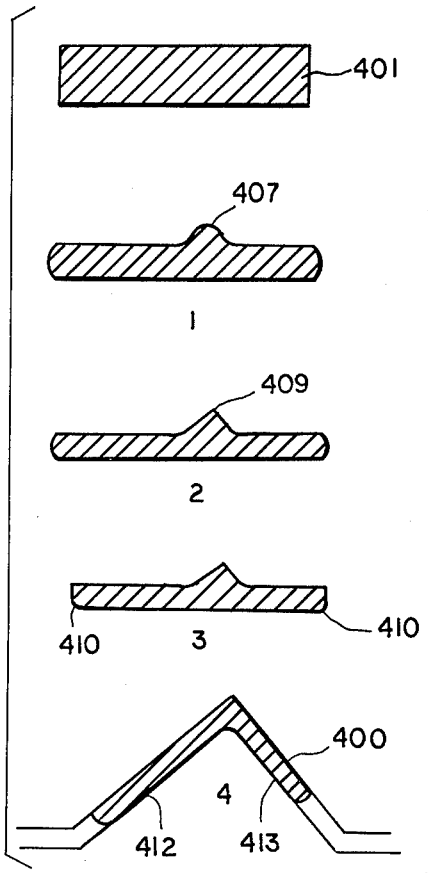
FIG. 4 is a diagram corresponding to FIG. 2 showing the formation of an angle with unequal width flanges.

FIG. 4 shows the application of the same principle to the production of angle shape 400 whose flanges 412 and 413 are of unequal widths.

This process also starts with a rectangular-section bar 401 and in the first pass provides a droplet-shaped bulge 407 which is offset to the right. This bulge is transformed into an asymmetrical triangle 409 in the second pass, and again in the third pass, the edges 410 are rounded prior to the final bending in the fourth pass.

Figure 5:
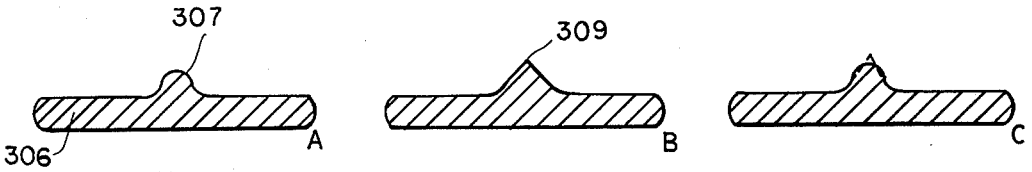
FIG. 5 is a diagram illustrating the formation of the triangular ridge in the system of FIG. 3.
Figure 6:
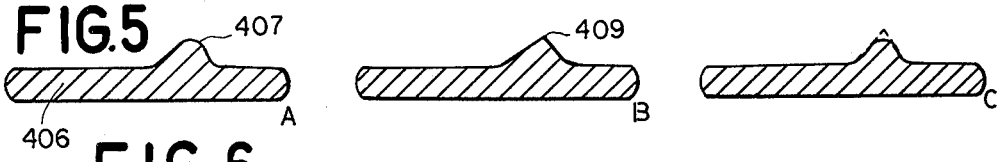
FIG. 6 is a diagram illustrating the formation of the triangular ridge in the system of FIG. 4.
Figure 7:
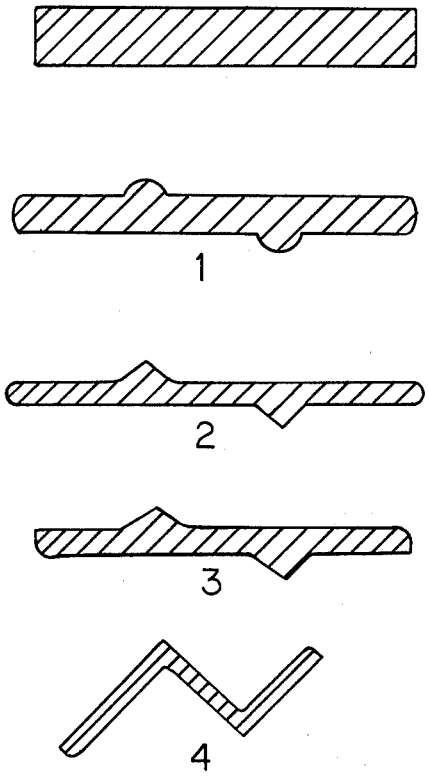
FIGS. 7 and 8 are views similar to FIGS. 3 and 4 for the production of Z and U profiles, respectively.

The shapes of the bulges 307 and 407 formed in the first pass for the respective blanks 306 and 406 have been illustrated in greater detail in FIGS. 6 and 7, step A. The volumes of the bulges 307 and 407 correspond precisely to those of the triangular ridges 309 and 409 (step B in FIGS. 5 and 6) as will be apparent from the drawings C of these FIGURES in which the triangular configuration is shown superimposed upon the respective bulges.

Figure 8:
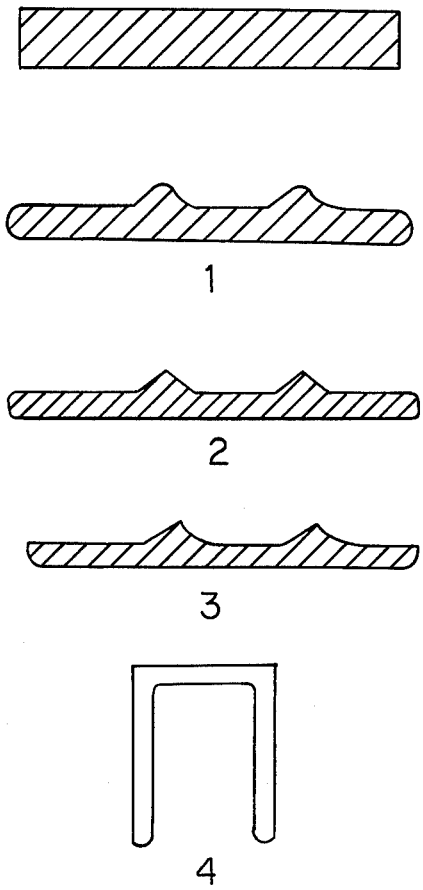

Naturally, the principles described in connection with FIGS. 3 and 4 also apply when the blank is to have two vertices, i.e. in the case of U-section structural shapes (FIG. 8) and Z-section structural shapes (FIG. 7), in which case appropriate bulges and ridges are formed at two locations on the blank.

Since the rolling sequence is greatly simplified by the method of the present invention, it is merely necessary to introduce four rolling stands into a flat bar rolling mill train to produce the angle iron or other shapes of the present invention. Obviously, the present invention greatly simplifies the production of structural shapes in general.

I claim:

1. A process for the rolling of a structural shape having two flanges joining at substantially a right angle the process consisting of:

(a) rolling a rectangular-section bar to form at least one convex bulge along a surface of a resulting rolled blank and a pair or wings separated by said bulge and of a thickness of about one-half the thickness of said bar, said blank having a flat planar unrecessed surface on its side opposite said bulge;

(b) thereafter in a second pass rolling said blank to reduce the thickness of said wings to about one third the thickness formed in step (a) and to transform said bulge into a triangular-section ridge while maintaining a flat planar unrecessed surface on the side opposite said ridge;

(c) rolling the blank of step (b) in a third pass to round outer edges along a surface of said blank opposite the surface on which said ridge is formed while maintaining a flat planar unrecessed surface on the side opposite said ridge between the rounder outer edges; and (d) after step (c) and without intervening steps bending said wings at a right angle to one another whereby said ridge forms a vertex between flanges of a structural shape resulting from the bending.

2. The method defined in claim 1 wherein said bar is commercial flat-rolled steel bar stock.

3. The method defined in claim 1 wherein said bar has a square cross section.

4. The method defined in claim 1 wherein said bulge and said ridge are formed centrally on the blank in step (a) and the structural shape resulting at step (d) is an angle shape with equal-width flanges.

5. The method defined in claim 1 wherein said bulge and said ridge on the blank are formed asymmetrically and the resulting structural shape has flanges of unequal widths.

6. The method defined in claim 1 wherein step (d) produces a U-section structural shape.

7. The method defined in claim 1 wherein step (d) produces a Z-section structural shape.

8. The method defined in claim 1 wherein the volume of said bulge is equal to the volume of said ridge.

* * * * *